United States Patent [19]

Zerbel

[11] 4,394,561

[45] Jul. 19, 1983

[54] TANK STRUCTURE FOR AN AIR HUMIDIFYING ELECTRODE STEAM GENERATOR

[75] Inventor: Allen J. Zerbel, Madison, Wis.

[73] Assignee: Wehr Corporation, Milwaukee, Wis.

[21] Appl. No.: 251,360

[22] Filed: Apr. 6, 1981

[51] Int. Cl.[3] ..... H05B 3/60; F22B 1/30; B65D 6/00

[52] U.S. Cl. ..... 219/285; 219/275; 219/288; 219/289; 261/142; 338/83

[58] Field of Search ..... 219/284–295, 219/271–276; 338/80–86; 261/142

[56] References Cited

U.S. PATENT DOCUMENTS

| | | | |
|---|---|---|---|
| 3,083,288 | 3/1963 | Vischer | 219/284 X |
| 3,119,925 | 1/1964 | Shomock | 219/288 |
| 3,222,499 | 12/1965 | Conlin et al. | 219/289 |
| 3,584,193 | 6/1971 | Badertscher | 219/289 X |
| 3,761,679 | 9/1973 | Dall | 219/288 |
| 4,092,519 | 5/1978 | Eaton-Williams | 219/289 X |

FOREIGN PATENT DOCUMENTS

| | | | |
|---|---|---|---|
| 47759 | 4/1937 | France | 219/288 |

*Primary Examiner*—A. Bartis

[57] ABSTRACT

The electrode steam generator includes a cylindrical water tank including mating top and bottom cylinder halves molded from an electrically insulative synthetic plastic material as substantial mirror images of each other so that both can be molded from dies of the same design. The open mating ends of the cylinder halve includes substantially identical, alternating tongue and groove sections which fit together when the halves are brought together. The closed, concave ends of the cylinder halves have a plurality of circumferentially-spaced circular bosses projecting externally and internally at locations corresponding to desired locations of the electrical terminals for the electrodes. The terminal bosses on both cylinder halves are the same, except at least some of the top half includes an electrode terminal integrally molded therein. Both halves include a radially extending row of at least two internally projecting mounting bosses radially aligned with and radially spaced from each of the terminal bosses and adapted to receive sheet metal screws or similar fasteners for anchoring the electrodes on the top half with at least one mounting boss in each row being circumferentially aligned with the corresponding boss in another row for permitting the spacing between the electrodes to be uniformly radially adjusted by connection of each electrode to a terminal and one of the mounting bosses of each row. Both halves also include circular bosses adapted to receive sheet metal screws or similar fasteners for anchoring a screen covering the water inlet opening on the bottom half. The mating ends include radially projecting, peripheral flanges which are removably held together by a hoop or band clamp which has a generally U-shaped cross section and fits over the flanges.

4 Claims, 7 Drawing Figures

TANK STRUCTURE FOR AN AIR HUMIDIFYING ELECTRODE STEAM GENERATOR

BACKGROUND OF THE INVENTION

This invention relates to air humidifiers employing an electrically operated steam generator and, more particularly, to the water tank for such steam generators.

Air humidifiers including an electrical steam generator for producing a stream of steam which is dispersed into the air distribution system of a building or the like are well known. The steam generator for such air humidifiers usually includes a water tank partially filled with water and a plurality of electrodes immersed in the water and connected to electrical terminals extending through the top of the tank. Electrical current flowing through the water causes the water to boil and a stream of steam is discharged through an opening in the top of the tank. A control system controls the operation of a valve which admits water into the tank through an opening in the bottom to maintain the water at a level necessary to produce steam at a rate required to obtain a desired humidification.

Tap water normally is used and minerals in the water, such as calcium carbonate, tend to deposit on the surfaces of the electrodes and in the tank. The tank must be opened to clean mineral deposits from the tank or replace the electrodes. It is known to make the tank in two sections which are removably coupled together with a mechanical means. However, separate molds usually are required for the bottom and top sections because such section must include provisions for mounting different components. For example, the top section usually includes provisions for mounting the electrodes while the bottom section includes provisions for mounting a filter screen covering the water inlet opening.

SUMMARY OF THE INVENTION

One of the principal objects of the invention is to provide a water tank for the electrical steam generator of an air humidifier which can be inexpensively manufactured.

Another of the principal objects of the invention is to provide such a water tank including two tank sections which are molded from a synthetic plastic material and are arranged so that both sections can be molded in a die of the same design.

A further of the principal objects of the invention is to provide such a water tank which can be conveniently opened for cleaning without any special tools.

Other objects, aspects and advantages of the invention should become apparent to those skilled in the air upon reviewing the following detailed description, the drawings and the appended claims.

The invention provides a generally cylindrical water tank for an electrical steam generator of an air humidifier including mating top and bottom cylinder halves molded from an electrically insulative plastic material as substantial mirror images of each other. Each of the halves has an open mating end and a substantially closed, opposite end including an opening and a plurality of circumferentially-spaced, externally and internally projecting bosses at locations corresponding to desired locations of the electrical terminals. The terminal bosses on the top and bottom halves are substantially identical except at least some on the top half includes an electrical terminal integrally molded therein. The mating ends of the top and bottom halves are removably held together to define a chamber with the opening in the bottom half serving as a water inlet and the opening in the top half serving as a steam outlet.

Both cylinder halves preferably include a plurality of circumferentially-spaced, radially-extending rows of internal bosses adapted to receive means for anchoring the upper end of the electrodes to the top half with one internal boss in each row being circumferentially aligned with corresponding internal bosses in the other rows. The mating ends of both cylinder halves preferably include substantially identical, alternating tongue and groove sections which fit together when the cylinder halves are brought together.

DESCRIPTION OF THE PREFERRED EMBODIMENT

Figure 1:
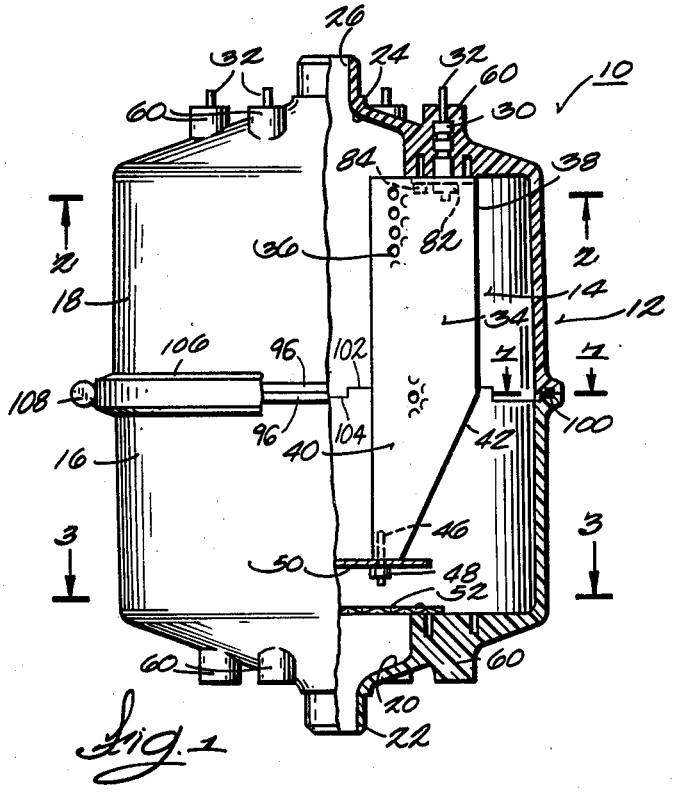
FIG. 1 is a side elevation, partially broken away view of a steam generator for an air humidifier incorporating various features of the invention.
Figure 7:
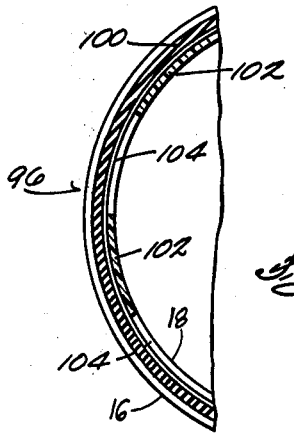
FIG. 7 is a fragmentary sectional view taken generally along line 7—7 in FIG. 1.

Illustrated in FIG. 1 is an electrically-operated boiler or steam generator 10 for an air humidifier. The steam generator 10 includes a generally cylindrical tank 12 partially filled with water and a plurality (e.g., 6) of circumferentially-spaced electrodes 14 disposed inside the tank 12 and partially immersed in the water.

The tank 12 is composed of two cylindrical halves, a bottom half 16 and a top half 18, molded from a synthetic plastic material, preferably a translucent material such as polypropylene so that the water level can be observed through the tank walls. The bottom cylinder half 16 has a generally concave bottom wall 20 including a water inlet 22 through which water is introduced into and drained from the tank 12 in the usual manner during operation of the humidifier. The top cylinder half 18 has a generally concave top wall 24 including a steam outlet 26 through which a stream of steam is discharged and dispersed in the usual manner into the air distribution system (not shown) for a building or the like.

Each of the electrodes 14 is connected to the inner end 28 of an electrical terminal 30 extending through the top wall 24 of the top cylinder half 18. The outer ends 32 of the electrical terminals 30 project externally of the tank 12 and are suitably connected to an electrical supply (not shown).

Each of the electrodes 14 includes a pair of vertically extending generally flat, elongated side members 34 which are perforated and are connected together in angular relationship along an inner edge to form a V-shaped cross section. The side members 34 diverge from each other in a radial direction toward the tank side wall and terminate in an outer edge spaced radially inwardly from the tank side wall. While the side members 34 can have a rectangular shape, in the specific construction illustrated, each side member 34 has a top or upper portion 36 including a substantially straight outer edge 38 which extends generally vertically and parallel to the tank side wall and a bottom or lower portion 40 including an outer edge 42 which extends at an incline downwardly and radially inwardly from the outer edge 38 of the top portion 36 toward the central axis of the tank 12.

A base plate 44 extending over the top edges of the electrode side members 34 and spot welded or otherwise affixed thereto provides rigidity and serves as a support for connecting each electrode 14 to an electrical terminal 30 and for anchoring each electrode 14 to underside of the top wall 24 of the top cylinder half 18 as described in more detail below. Affixed on the lower end of each electrode 14 and depending therefrom is a threaded stud 46. The studs 46 are fastened, by nuts 48 or the like, to a horizontally extending, circular disc 50 of electrically insulative material which serves to stabilize the lower ends of the electrodes 14.

A rectangular screen 52 covering the water inlet 22 and fastened to the bottom wall 20 of the bottom cylinder half 16 serves as a strainer for preventing particulate contaminants (e.g., precipitated minerals) from passing out of the tank 12 during the drain cycle.

Figure 3:
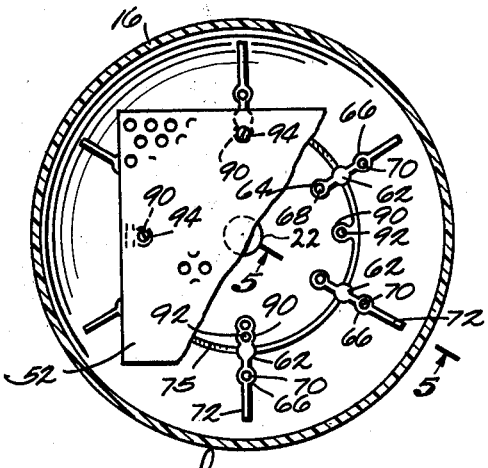
FIG. 3 is a fragmentary, sectional view, taken generally along line 3—3 in FIG. 1.
Figure 5:
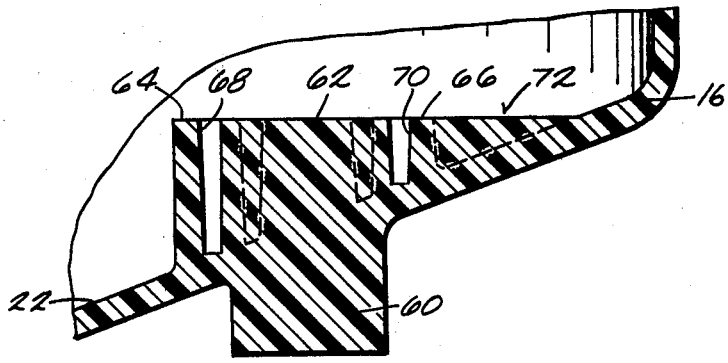
FIG. 5 is an enlarged, fragmentary, sectional view taken generally along line 5—5 in FIG. 3.

To minimize fabrication costs, the bottom and top cylinder halves 16 and 18 are arranged as mirror images of each other so that dies of the same design can be used for molding both. More specifically, both the bottom and top cylinder halves 16 and 18 are provided with a plurality of circumferentially-spaced circular bosses 60 and 62 projecting externally and internally, respectively, at locations corresponding to the desired location of the electrical terminals 30. The die configuration for molding the bottom and top cylinder halves 16 and 18 is the same except, when molding a top cylinder half 18, an electrical terminal 30 is installed as a mold insert in the die parts forming the bosses 60 and 62. The electrical terminals 30 are molded into either all of the bosses 60 and 62 or every other one, depending on the number of electrodes to be used. The bosses 60 and 62 on the bottom cylinder half 16 are solid as shown in FIGS. 3 and 5.

The inner end 28 of the electrical terminals 30 are threaded to facilitate connection of the electrodes 14 as described in more detail below and the outer ends 32 of the electrical terminals 30 usually are smooth.

Figure 4:
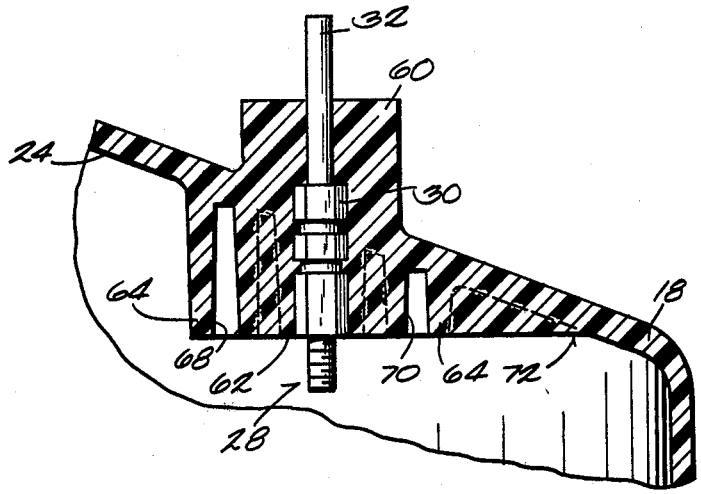
FIG. 4 is an enlarged fragmentary, sectional view taken generally along line 4—4 in FIG. 2.

The electrodes 14 preferably are connected to the electrical terminals 30 and anchored to the underside of the top wall 24 of the top cylinder half 18 in a manner whereby the side members 34 of adjacent electrodes 14 are parallel and uniformly spaced and are maintained parallel when the horizontal distances therebetween is adjusted to compensate for water conductivity. This can be accomplished by providing a row of circular bosses 64 and 66 on the underside of the top wall 24 in conjunction with and radially aligned with each terminal boss 62, and thus electrical terminal 30. As shown in FIGS. 4 and 5, the inner ends of the bosses 64 and 66 and the electrical terminal boss 62 terminate in a common horizontally extending plane.

Figure 2:
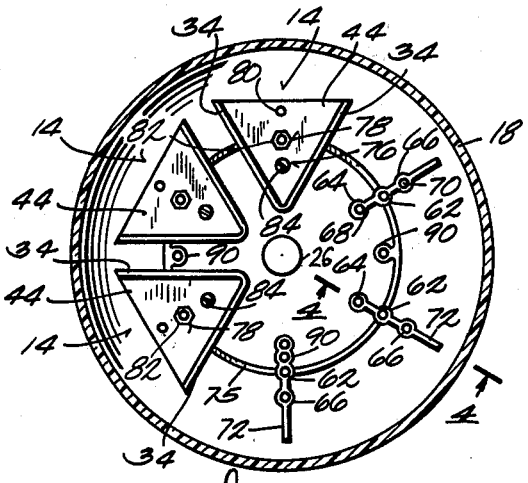
FIG. 2 is a fragmentary, sectional view taken generally along line 2—2 in FIG. 1.

The bosses 64 and 66 respectively include central apertures 68 and 70 which are radially spaced at equal intervals from the opposite sides of the corresponding electrical terminal 30 and are adapted to receive a sheet metal screw or similar fastening means. As shown in FIGS. 2 and 3, the bosses 64 and 66 in each row are circumferentially aligned with corresponding bosses in the other rows. The bosses 64 and 66 and the terminal boss 62 are interconnected by a radially-extending strengthening rib 72 which extends radially outwardly from the boss 68 to join the curved wall 20 or 24 and has an inner edge extending coplanar with the inner ends of the bosses 62, 64 and 66. The terminal bosses 62 are interconnected by a circumferentially-extending strengthening rib 75.

As shown in FIG. 2, each electrode base plate 44 is provided with a radially extending row of apertures 76, 78 and 80 which are adapted to receive the inner end portion 28 of an electrical terminal 30 and are spaced at equal intervals so that, when an electrical terminal 30 is positioned on one of the apertures 76, 78 or 80, at least one other of these apertures is in registration with one of the boss apertures 68 and 70. The circular disk 50 has circumferentially spaced, axially extending rows of apertures which are adapted to receive an electrode stud 46 and which are spaced at equal intervals like apertures 76, 78 and 80.

As shown in FIG. 2, the electrode terminals 30 are positioned in the base plate apertures 78 and the base plate apertures 76 are in registration with the boss apertures 68. The electrodes 14 are electrically connected to the electrical terminal 30 by a nut 82 threaded onto the inner end portion 28 of the electrical terminal 30 projecting through the base plate aperture 78. The electrodes 14 are anchored to the top wall 24 by a sheet metal screw 84 extending through the base plate aperture 78 and tapped into the boss aperture 68.

The horizontal distance between the electrodes 14 can be adjusted to compensate for different water conductivities by removing the nuts 82, the screws 84, and the nuts 48 from the electrodes studs 46 positioning the electrical terminal 30 in the appropriate base plate aperture, positioning the electrodes studs 46 in the appropriate apertures of the disk 50, threading the nut 82 back onto the inner end 28 of the electrical terminal 30, threading the nuts 48 back onto the electrode studs, and threading the sheet metal screws 84 into a boss aperture in registration with a base plate aperture. Since the boss apertures extend in a row radially aligned with an electrical terminal and the base plate apertures are radially aligned, the electrodes 14 are moved along a radial line and the side members 34 of adjacent electrodes 14 remain parallel during this adjustment.

The bottom cyliner half 16 includes four cylinder bosses 90 which are spaced 90° apart and have a central aperture 92 adapted to receive a sheet metal screw or similar fastening means. The screen 52 is anchored to the bottom wall 20 of the bottom cylinder half 16, in place over the water inlet 22, by sheet metal screws 94 tapped into the boss apertures 92.

Since a die of the same design can be used for molding the top and bottom cylinder halves, the bottom cylinder half 16 includes circular bosses 62 and 64, just like the top cylinder half 18, and the top cylinder half 18 includes bosses 90, just like the bottom cylinder half 16, even though they are not used.

Each of the mating open ends of the bottom and top cylinder halves 16 and 18 includes a radially projecting, peripheral flange 96 including a peripheral groove 98 for receiving a gasket 100 which is adhesively bonded in the groove 98 of the bottom cylinder half 16. Each of the mating ends also includes a plurality of identical, alternating arcuate ridges or tongue sections 102 and arcuate recesses or groove sections 104 located radially inwardly from the gasket groove 98.

Figure 6:
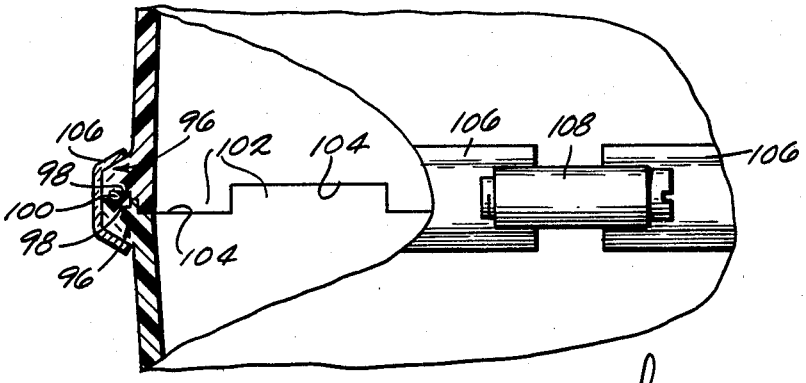
FIG. 6 is an enlarged fragmentary view showing the mating flanges of the cylinder halves and the hoop clamp holding them together.

When the cylinder halves are brought together, the tongue sections 102 on one cylinder half fit into the groove sections 104 of the other cylinder half, and vice versa, as shown in FIG. 6. The cylinder halves 16 and 18 are held together by a hoop or band clamp 106 which has a generally U-shaped cross section and fits over the flanges 96. The flanges 96 are clamped together in sealing engagement with the gasket 98 by tightening a threaded retainer 108 on the clamp 106.

The tank 12 can be conveniently opened for cleaning, electrode replacement or electrode adjustment by simply loosening the clamp retainer 108 sufficiently to permit the clamp 106 to be removed from the flanges 96 and then separating the cylinder halves.

From the foregoing description, one skilled in the art can easily ascertain the essential characteristics of the invention and, without departing from the spirit and scope thereof, make various changes and modifications to adapt it to various usages.

I claim:

1. A generally cylindrical water tank for an electrical steam generator of an air humidifier including a plurality of electrodes mounted inside the tank in circumferentially-spaced relationship with each connected to a separate electrical terminal, said tank comprising:

mating top and bottom cylinder halves molded from an electrically insulative plastic material as substantially mirror images of each other, each of said halves having an open mating end and a substantially closed, opposite end including an opening and a plurality of circumferentially-spaced, externally and internally projecting bosses at locations corresponding to desired locations of the electrical terminals, the terminal bosses on said top and bottom halves being substantially identical except at least some of said top half includes an electrical terminal integrally molded therein, each of said halves further including a radially extending row of at least two internally projecting mounting bosses radially aligned with and radially spaced from each of said terminal bosses, each of said mounting bosses adapted to receive means for anchoring the upper end of an electrode on said top half with one mounting boss in each row being circumferentially aligned with a corresponding boss in another row; and means for removably holding said mating ends of said top and bottom halves in assembly to define a chamber with the opening in said bottom half serving as a water inlet and the opening in said top half serving as a steam outlet.

2. A water tank according to claim 1 wherein each of said halves further includes a plurality of circumferentially-spaced, internal bosses, in addition to said terminal and said mounting bosses, adapted to receive means for fastening a screen covering the water inlet opening to the inside of said bottom half.

3. A water tank according to claim 1 wherein the mating ends of said top and bottom halves include substantially identical, alternating tongue and groove sections which fit together when said halves are assembled.

4. A water tank according to claim 3 wherein said mating ends of said top and bottom halves further include a radially, outwardly projecting, peripheral flange; and said holding means comprises a hoop-like clamp which has a U-shaped cross section and is adapted to clampingly engage said flanges and means for tightening said clamp onto said flanges.

* * * * *